United States Patent [19]

Roop et al.

[11] 4,434,869

[45] Mar. 6, 1984

[54] RESCUE APPARATUS

[76] Inventors: Michael R. Roop, 4525 Tartan Dr., Baton Rouge, La. 70816; Russell P. Cook, Sr., 2918 Little Farms Dr., Zachary, La. 70791

[21] Appl. No.: 386,206

[22] Filed: Jun. 7, 1982

[51] Int. Cl.[3] ..... A62B 1/08

[52] U.S. Cl. ..... 182/10; 182/191

[58] Field of Search ..... 182/10, 11, 191, 192; 104/112, 183, 174, 173 R, 173 ST

[56] References Cited

U.S. PATENT DOCUMENTS

| | | | |
|---|---|---|---|
| 96,710 | 11/1869 | Lotz | 182/73 |
| 249,847 | 11/1881 | MacDonald | 182/10 |
| 346,406 | 7/1886 | Hutchings | 182/10 |
| 468,208 | 2/1892 | Prunetti | 104/183 |
| 1,101,910 | 6/1914 | Gimquist | 182/11 |
| 2,699,199 | 1/1955 | Huntington | 104/112 |
| 3,012,518 | 12/1961 | Sawyer | 104/173 R |
| 3,585,940 | 6/1971 | Hancock | 104/173 ST |
| 3,702,124 | 11/1972 | Highland | 104/112 |
| 4,348,960 | 9/1982 | Staurseth | 104/173 R |

FOREIGN PATENT DOCUMENTS

| | | | |
|---|---|---|---|
| 526484 | 9/1929 | Fed. Rep. of Germany | 104/112 |
| 2348 | of 1870 | United Kingdom | 182/10 |

*Primary Examiner*—R. P. Machado
*Assistant Examiner*—Alvin Chin-Shue
*Attorney, Agent, or Firm*—Huff & Hanson

[57] ABSTRACT

An apparatus for transporting personnel or materials from an upper elevation to a lower elevation. Twin guideline means are suspended between the upper and lower elevations from each of which is suspended a carrier means. The two carrier means are simultaneously moveable in opposite directions along their respective guideline means.

18 Claims, 4 Drawing Figures

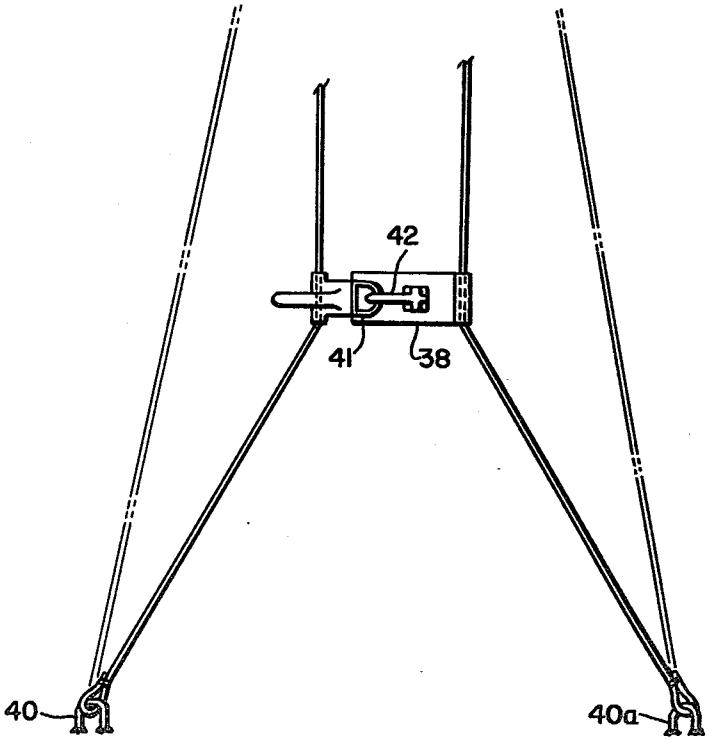
Fig. 4
Fig. 3
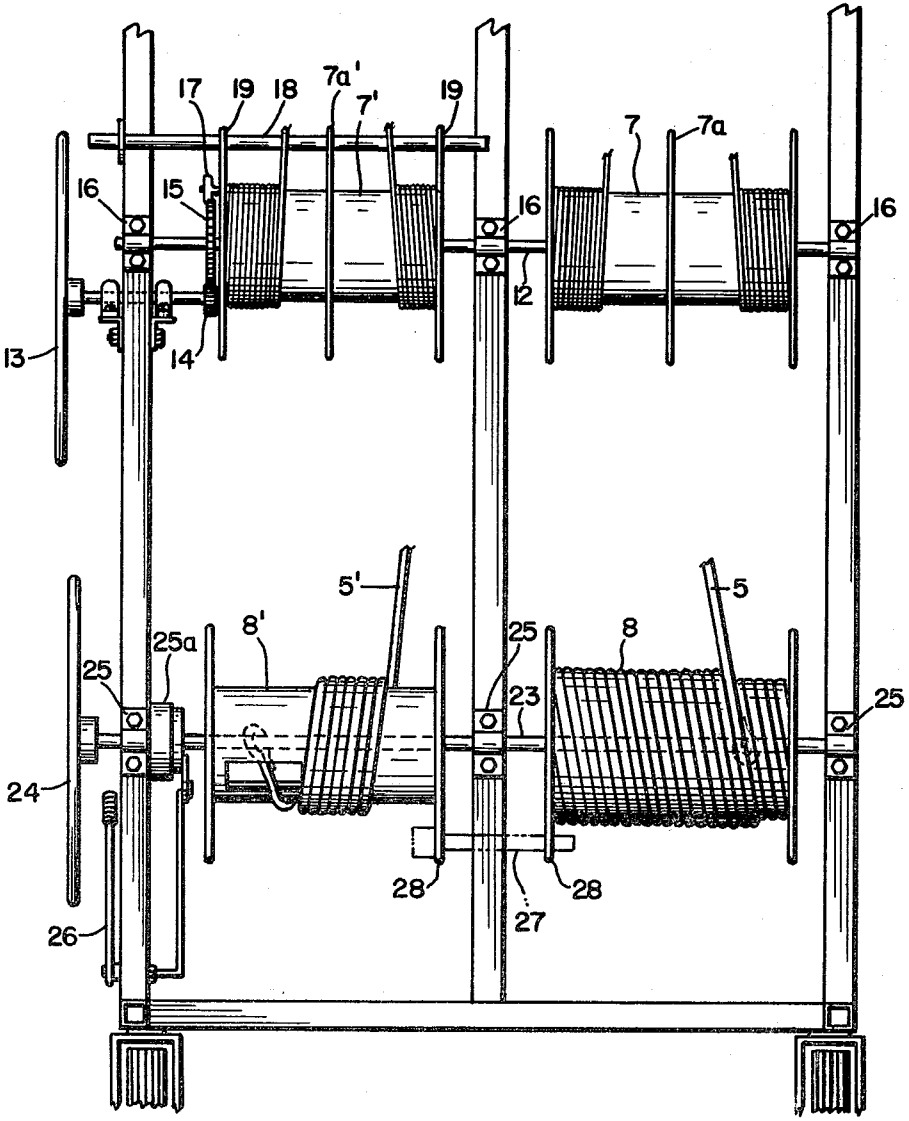

RESCUE APPARATUS

BACKGROUND OF THE INVENTION

1. Field of the Invention

This invention relates to an apparatus for transporting personnel or materials from an elevated location to a lower location.

The development of high rise structures has been accompanied by serious evacuation problems. Tall buildings present serious obstacles to rescue personnel seeking to remove a structure's occupants from upper floors. Rescue ladders seldom reach beyond eight stories so that occupants beyond this level and above the fire line are poorly served by conventional rescue methods.

Alternative methods of rescue such as helicopter evacuation are often impeded by smoke interfering with a pilot's vision or by rooftop structural limitations. Furthermore, the rotor wash of a helicopter can spread or otherwise intensify a fire. Finally, seriously inclement weather or high winds can ground rescue aircraft.

Rappelling techniques, in which personnel are vertically lowered along the outside surface of a building, have been proposed as another rescue alternative for skyscrapers. Examples of such vertical escape techniques can be found in U.S. Pat. Nos. 121,796 and 409,511. These methods, however, are unsuited for use in any situation where flames or any other obstacles obstruct the route of descent. To overcome these deficiencies, various apparatus and techniques have been evolved whereby the line of descent follows a diagonal rather than a vertical slope, carrying persons away from the building rather than along its side. Consequently, persons or objects can be transported out of the danger zone much faster than with vertical rappelling techniques. One such method employs a Tyrolean traverse utilizing a telpher, or guide line, suspended between an elevated embarkation point and a lower receiving point. A load-carrying device is suspended from the guide line and is capable of traversing the length thereof. One such device, described in U.S. Pat. No. 249,847, relates to a fire rescue apparatus based at a lower elevation, comprising a unitary windlass for tightening and loosening two guide lines suspended between the embarkation and receiving points. A carrying means is suspended from each guide line, and an endless traveling line, or lifeline, passes through a pulley secured at the elevated embarkation point. The lifeline is connected to each carrier means and passes around a windlass which imparts an alternate longitudinal movement to each side of the lifeline. This arrangement results in the carrying means suspended from one guide line being lowered while the carrying means suspended from the other guide line is simultaneously raised. This double guide line method is inherently more efficient than a single guide line traverse because it is simultaneously bidirectional, i.e., there is simultaneous upward and downward transport capability. In addition, motive power requirements are reduced because the downward bond load counterbalances the upward bound load and vice versa.

Other transport devices employing a carrier means suspended from a guide line are disclosed in U.S. Pat. Nos. 38,078; 89,686; 293,177; 293,322; 317,704; 430,225; 734,230; 3,826,335; and 4,056,167.

SUMMARY OF THE INVENTION

The present invention relates to a method and apparatus for transporting personnel or other cargo between higher and lower elevations. The apparatus provides a sumultaneously bidirectional transport means comprising a support frame which can be positioned or anchored at the higher elevation. The frame contains a right guideline means spool and a left guideline means spool to which spools are attached the proximal ends of the right and left guideline means, respectively. The distal ends of said guideline means can be anchored to the lower elevation to provide a right and left guideline means suspended between the higher and lower elevations. A carrier means can be suspended from each of said guideline means. The guideline means spools comprise a capability for tensioning said guideline means. A towline spool means, around which a right towline and a left towline are respectively wrapped in opposite directions, is also mounted in the support frame, preferably beneath the right and left guideline means spools. The proximal ends of each towline are attached to the towline spool means. Carrier means are suspended from each guideline means by way of a suitable attachment means such as a pulley. The distal end of each towline is attachable to a carrier means. The suspended carrier means are positioned such that the carrier means suspended from one guideline means is near or at the higher elevation while the carrier means suspended from the other guideline means is near or at the lower elevation. When the towline spool means is rotated, one towline is reeled in towards the towline spool means while the other towline is simultaneously pair out. This arrangement results in simultaneously bidirectional movement of the carrier means attached to the towlines.

The apparatus of the present invention can be used to transport personnel and cargo over relatively great distances. For example, loads can be transported easily from the roof of a fifty story building to the roof of an adjacent thirty story building. In fact, distances of eight hundred feet and beyond can be traversed with the apparatus of the present invention. Because of the increasing stress placed on a guideline means as the distance between its support points increases, it is necessary to provide the apparatus with guidelines of suitable strength and durability. It has been found that static (non-stretch) nylon line of sheath and core construction such as one-half inch kernmantel, available from Pigeon Mountain Industries of Lafayette, Ga., is well-suited for use in the guideline means of the present invention. Such line can be obtained in various colors which allows color coding each line to its particular lower elevation suspension point, thus facilitating and expediting set-up of the apparatus.

The strength and durability of nylon sheath-and-core lines commends their use as towlines as well as guidelines in the apparatus of the present invention.

The safety and reliability of the present invention can be enhanced by incorporating various back-up features therein. Such features include guidelines means which comprise more than one guideline. In addition, each carrier means can be independently suspended from each guideline. Consequently, should one guideline of a guideline means break, the remaining guideline or guidelines are capable of bearing the load of the carrier means. For simplicity's sake a guideline means generally consists of no more than two guidelines; however, more than two can be employed as well.

Another safety feature relates to an alternate means for slowing and stopping a carrier means suspended from two horizontally parallel guidelines as it approaches the lower elevation. The carrier means is suspended from at least one pair of horizontally parallel pulleys each of which is connected to the carrier means by a pulley-to-carrier means connector, such as a line, having a set length. This set length results in a maximum separation distance that can be maintained between any pair of horizontally parallel pulleys, i.e., a maximum interpulley separation distance. Said guidelines of each guideline means are secured to the lower elevation at an interguideline distance from each other which is greater than the maximum interpulley separation distance. When said alternate braking means is not in use, a releasable constraining means such as a belt encircles the distal region, i.e., the lower elevation region, of the guideline pair, drawing them together at an interguideline distance which is less than or about equal to the maximum interpulley separation distance. When said guidelines are thus constrained, a carrier means will freely travel along its guideline means to the constraining means at the lower elevation, with its braking dependent only on its towline. Towline braking is controlled by an operator stationed at the upper elevation who brakes the towline spool means. When the constraining means is released, the interguideline distance at the distal region between the guidelines is increased to a distance greater than the maximum interpulley separation distance. When this occurs, a descending carrier means will slow down and stop as it approaches the lower elevation. Such braking is the result of the friction created by the pulleys binding on the guidelines. Once the constraining means is loosened, the alternate braking means can operate automatically, i.e., without human assistance. This alternate braking means is of particular importance to the apparatus operator or operators stationed at the upper elevation. When said personnel evacuate the upper elevation, no operator can remain on hand to manually brake the final descent. Consequently, without the aforementioned alternate braking means, the final run would have to be made with no braking capability.

The present invention may also comprise a means to prevent or reduce carrier means sag at the proximal end of each guideline means, i.e., at the upper elevation region. Such sag results from the weight of a carrier means on a guideline means. When a carrier means is being launched from the upper elevation, such sag can prevent a carrier means from clearing the roof edge. To overcome such problems, the carrier means can be fitted with a transverse member whose ends can fit on inclined anti-sag guides attached to the right and left sides of the support frame. The guides are placed such that they support the carrier means as it traverses the length of the guides. The guides extend downward from and beyond the front of the support frame to ensure adequate clearance of the carrier means with respect to roof obstructions.

Carrier means sag is particularly evident where a guideline means consists of a single guideline. Where a guideline means comprises more than one guideline, the carrier means sag is significantly reduced. However, the transverse members and anti-sag guides still serve a useful purpose in such embodiments, particularly in the event that a guideline fails, reducing a guideline means to a single guideline susceptible to carrier means sag.

The effectiveness of the present apparatus is greatly enhanced when the support frame and its attendant hardware can be moved about the upper elevation surface. A fire localized on one side of a building may hinder the use of the present invention on that side of the building. Consequently, portability is a desirable quality in the present invention. To this end, the support frame can be mounted on wheels. The resulting apparatus can be wheeled to any side of the building and rescue efforts commenced. In addition, a means for rapidly anchoring the support frame to the upper elevation can be provided at suitable positions along the building's upper elevation perimeter. Such means can comprise a support frame which is engageable by any suitable means to an anchoring means permanently mounted at the upper elevation. Preferably, the support frame can be rapidly engaged and locked as well as rapidly unlocked and disengaged from the permanently mounted anchoring means. Alternate methods of anchoring the support frame include securing one or more cables or lines to the upper rear portion of the support frame and securing the other end or ends to a point or points at the upper elevation behind the support frame.

DESCRIPTION OF THE DRAWINGS

In the drawings forming a part of the disclosure herein, like character references designate like parts throughout the several views wherein.

FIG. 3 is a rear view of the support frame and its attendant hardware showing a detailed view of the upper guideline means spools and the lower towline spools.

FIG. 4 is an overhead view of a lower elevation guideline means anchoring means showing an alternate means for slowing and stopping a carrier means suspended from two horizontally parallel guidelines, as it approaches the lower elevation.

DETAILED DESCRIPTION OF THE INVENTION

Figure 1:
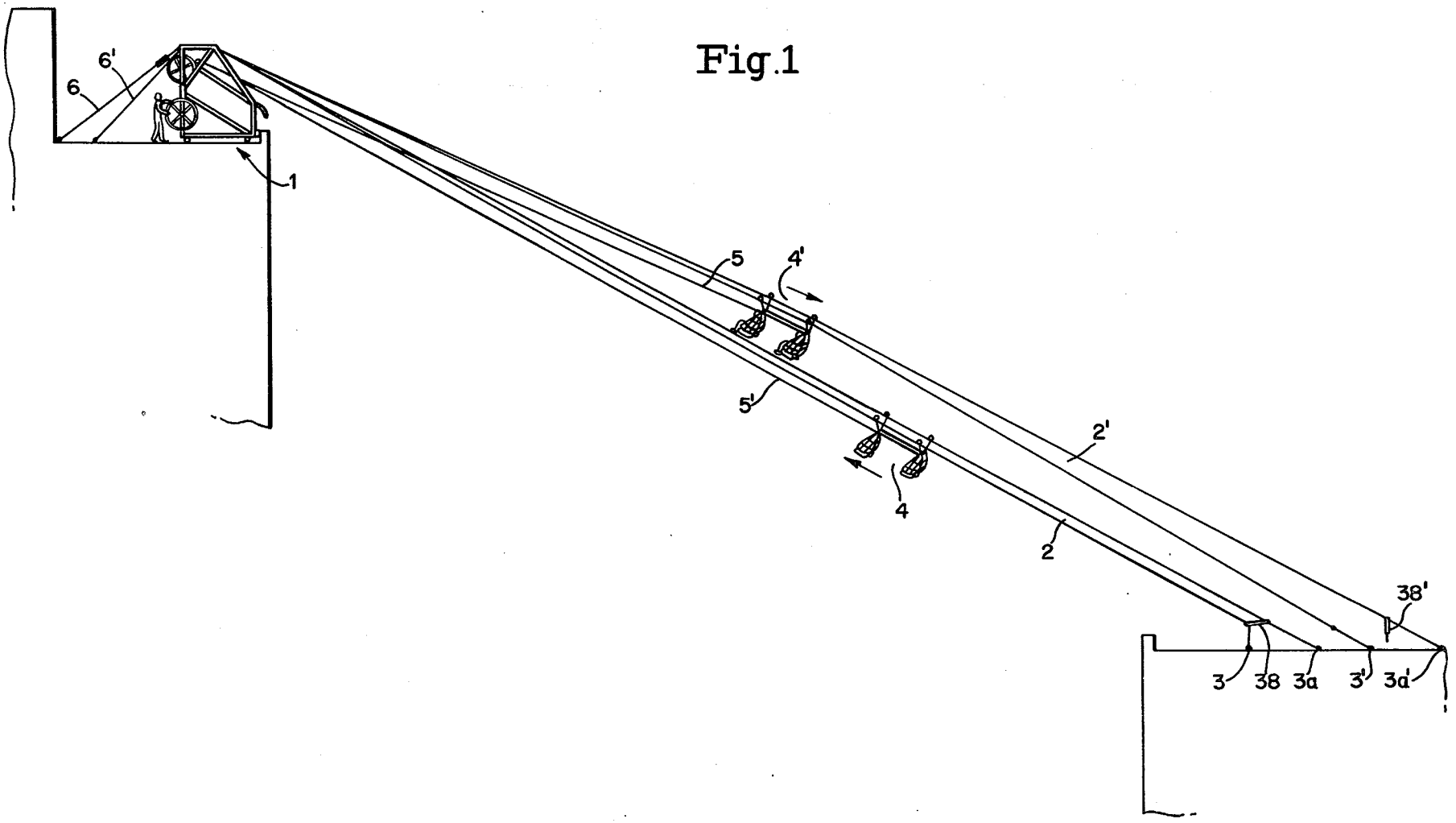
FIG. 1 is a side view of one embodiment of the apparatus in operation conveying a load between a higher elevation and a lower elevation.

Shown in FIG. 1 is a side view of one embodiment of the present invention in operation conveying a load between a higher elevation and a lower elevation. The apparatus comprises support frame 1 which pays out a right guideline means 2 and a left guideline means 2' both of which consist of two separate guidelines. The ends of the guideline means distal from the support frame are secured to the lower elevation at anchor points 3,3*a* and 3', 3*a*'. Suspended from each guideline means is a carrier means 4 and 4'. Attached to each carrier means is the distal end of towlines 5 and 5'. The proximal ends of said towlines are attached to a towline spool means mounted in the support frame and wrapped around said spool means in opposite directions such that rotation of said spool means imparts movement in opposite directions to each carrying means. The support frame may be secured in its position by means of an anchored cable 6 (and, optionally 6', see FIGS. 1 and 2). Personnel or other cargo are loaded into a carrying means positioned at the higher elevation. The added weight of the cargo causes the cargo carrying means 4' to travel along its guideline means to the lower elevation, while simultaneously causing the empty carrying means 4 to travel upward along its respective guideline means from the lower elevation to the higher elevation. The empty cargo carrying means is loaded at the upper elevation while the cargo carrying means is unloaded at the lower level. The roles of the carrying means are thus reversed and a second load can be transported from the upper elevation to the lower elevation and so on.

Figure 2:
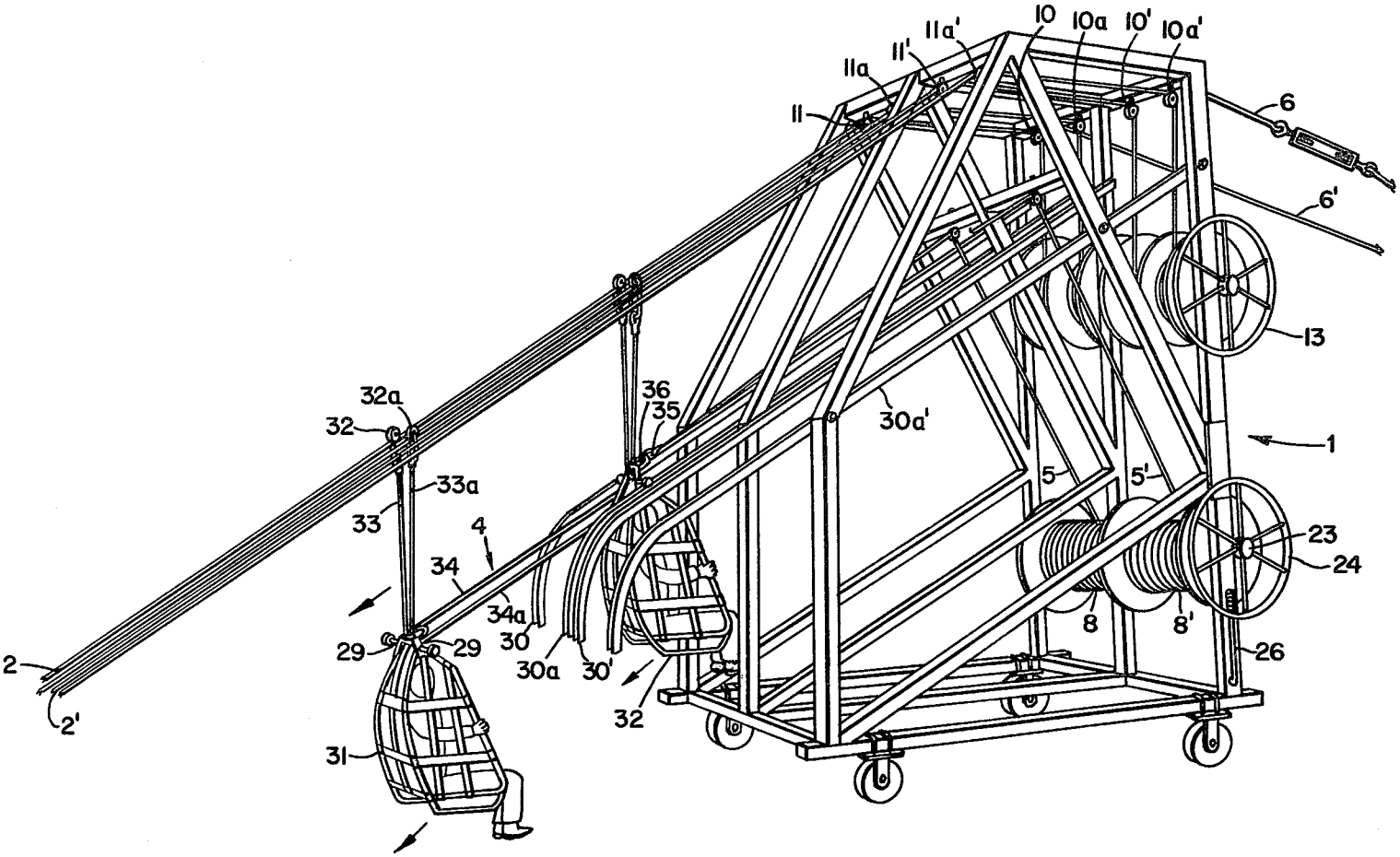
FIG. 2 is a frontal perspective view of the support frame and its attendant hardware showing the location and operation of the upper guideline means spools, lower towline spools, and a detailed view of the carrier means.

Shown in FIG. 2 is a detailed frontal perspective view of a preferred embodiment of the present invention comprising a support frame 1 of suitable material, e.g., 3"×3"×¼" members of aircraft aluminum. The resulting support frame has a vertical rear profile and a sloping front profile. Supported within the upper rear portion of the frame is a pair of guideline means spools comprising a right guideline means spool 7 and a left guideline means spool 7'. Mounted below said guideline means spools is a towline spool means consisting of a right towline spool 8 and a left towline spool 8'. A right guideline means 2 herein consisting of a pair of guidelines having sufficient strength and durability such as ½" to ⅝" kernmantel is attached to the right guideline means spool 7. A left guideline means 2' is similarly attached to a left guideline means spool 7'. Both the right and left guideline means spools are provided with center flanges 7*a* and 7*a*' respectively, (see FIG. 3) which allows for individual storage of each guideline in the resulting divided spools. Said guideline means are of sufficient length to reach from the higher elevation to the lower elevation selected. The guidelines can be stored around the guideline means spools when the apparatus of the present invention is not in use. When the apparatus is engaged, both right guidelines are unwound from the right guideline means spool and individually threaded through a line support system comprising adjacent rear guideline support means 10 and 10*a*, and right front guideline support means 11 and 11*a*. Said support means can be an eye, pulley or any other suitable support means, preferably one which reduces friction on the guideline means. The left guidelines are supported by analogous support means 10' and 10*a*', 11' and 11*a*'. Preferably, guideline means can be transmitted to the lower elevation by unwinding a guideline from its spool and shooting it across and below to the lower elevation point by means of a suitable line throwing gun. Personnel at the lower elevation secure the thrown guideline and the remaining lines can then be readily transmitted across the suspended line. Both guideline means are secured at the lower elevation anchor points, the right guideline means to 3 and 3*a*, and the left guideline means to 3' and 3*a*' as is shown in FIG. 1.

Also shown in FIG. 2 is a means to prevent or reduce carrier means sag when a carrier means is in the upper elevation region. This means comprises a transverse member 29 whose ends can fit on and between inclined anti-sag guides 30 and 30*a* or 30' and 30*a*'. Said guides support the carrier means as it traverses the length of the guides thus preventing carrier means sag at the crucial upper elevation launch point.

The carrier means 4 includes two lightweight chairs 31 and 32 comprising an aluminum frame and interwoven nylon webbing. Each chair is independently suspended from two pulleys 32 and 32*a* by means of pulley-to-carrier means connectors 33 and 33*a* having a tensile strength of at least about 3,000 lbs. The chairs are interconnected by high tensile strength connecting means 34 and 34*a*. The clasp 35 of towline 5 is attached to the carrier means 4 at the carrier means towline connection 36. Carrier means of identical construction are suspended from the left guideline means. The separate shafts both may be each rotatable by means of a pilot wheel which transmit force to a spur gear coacting with a pinion gear mounted on a guideline means spool.

FIG. 3 depicts a rear view of the support frame, including a detailed view of both the right and left upper guideline means spools as well as the lower towline spool means. As shown by FIG. 3, the tension of the guideline means can be adjusted by rotating the guideline means spools 7 and 7'. In the present embodiment both the right and left guideline means spools can be mounted on the same shaft 12 of sufficient diameter, preferably about 1½". This guideline means spool shaft is mounted to support frame 1 by means of pillow blocks 16. The shaft can be rotated by a pilot wheel mounted directly to said shaft (not shown) or by an independently mounted pilot wheel 13 which transmits rotary force through a gear arrangement such as that employing spur gear 14 coacting with pinion gear 15 which is mounted on a guideline means spool. Alternatively, the guideline means spools can be independently mounted on separate shafts to allow individual adjustment of the right and left pairs of guidelines. A locking and tensioning means is provided for the guideline means which comprises a pawl 17 which coacts with pinion gear 15 which acts as a ratchet. The resulting ratchet and pawl system allows rotation of the guideline means spool in only one direction unless the pawl is released. An optional positive lock system can effectively lock the guideline means spools in one position. This system comprises a bar 18 which is insertable through passages 19 in the guideline spool flanges. As the spool turns the bar is obstructed by the support frame 1 which prevents further movement of the spool.

Mounted beneath the guideline means spools is the towline spool means which herein consists of right and left towline spools 8 and 8' mounted on a common shaft 23 of suitable strength which shaft is mounted to the support frame by pillow blocks 25. Attached to the shaft is a pilot wheel 24. Towlines 5 and 5' are wound around their respective towline spools 8 and 8', in opposite directions. Consequently, the towline spool means takes up a towline on one side while paying out the other towline simultaneously, in spite of both towline spools rotating in the same direction. A braking means such as a disc and caliper brake or drum brake is provided in order to brake the common shaft 23. Such braking means can be operated by a pedal or handle 26 attached to the braking means 25*a*. An optional positive lock means can be used for locking the towline spools in one position. One such means comprises a bar 27 which is inserted through passages in the central flanges 28 of the towline spools. When the positive lock is in operation, the bar is obstructed by the support frame 1 which results in limited movement of the common towline spool shaft 23.

In FIG. 1 is shown an alternate braking means which can automatically stop a descending carrier means as it approaches the lower elevation. By anchoring the distal ends of each pair of guidelines so each guideline diverges from the other, a descending carrier means will slow and stop at its pulley means bind the ever diverging guidelines of guideline means 2'. In order to permit unencumbered passage of a carrier means to the lower elevation, a quick-release constraining means 38 is secured around the guideline pair of guideline means 2. Upon release of the constraining means 39 the guideline pair of guideline means 2' diverges.

FIG. 4 depicts the operation of the quick release constraining means 38 on a guideline pair secured to divergently mounted anchoring means 40 and 40*a*. On one end of the constraining means 38 is a D-ring 41 which attaches to a V-shaped member 42 in an easily releasable configuration. Sections of the guideline above the constraining means 38 can be maintained in a parallel position when the constraining means is fastened. Upon release of the constraining means, the entire length of the guideline pair diverges as is shown by the broken lines of FIG. 4.

It is claimed:

1. An apparatus for transporting personnel or other cargo between higher and lower elevations comprising:

(1) a support frame anchorable at the higher elevation in which frame is mounted: a right guideline means spool to which are attached the proximal ends of a right guideline means and a left guideline means and respectively, the distal ends of said guideline means being anchorable to the lower elevation, said guideline means spools having a means for tensioning said guideline means; a towline spool means having a right towline and a left towline which towlines are wound around said towline spool means in opposite directions, and (2) carrier means suspendable from each guideline means by a pulley means, said carrier means being attachable to the distal end of each towline and positioned such that the carrier means suspended from one guideline means is near or at the higher elevation while the carrier means suspended from the other guideline means is near or at the lower elevation, said carrier means comprising a transverse member whose ends can fit on inclined anti-sag guides attached to the right and left sides of the support frame, said guides being placed such that they support the carrier means as it traverses the length of the guides, said guides extending downward and beyond the front of said support frame.

2. The apparatus of claim 1 wherein said towline spool means comprises a right towline spool and a left towline spool mounted on a common shaft to which the proximal ends of said right and left towlines are respectively attached.

3. The apparatus of claim 2 wherein said guideline means spools are mounted on seperate shafts both of which are rotatable by means of a pilot wheel which transmits force to a spur gear coacting with a pinion gear mounted on a guideline means spool.

4. The apparatus of claim 3 wherein the tensioning means for said guideline means comprises a ratchet and pawl mechanism mounted on a guideline means spool which ordinarily allows rotation of the spool in only one direction.

5. The apparatus of claim 4 wherein rotation of said towline spool means is braked by means of a drum brake apparatus acting on the common towline spool shaft.

6. The apparatus of claim 4 wherein rotation of said towline spool means is braked by means of a disc and caliper brake apparatus acting on the common towline spool shaft.

7. The apparatus of claim 1, 2, 3, 4, 5 or 6 wherein each carrier means comprises a chair having an aluminum frame with interwoven nylon webbing.

8. The apparatus of claim 1 or 6 wherein each guideline means comprises a single guideline.

9. The apparatus of claim 1, 2, 3, 4 or 6 wherein each guideline means comprises a pair of parallel guidelines.

10. The apparatus of claim 9 wherein said guidelines are one-half inch nylon kernmantle rope.

11. The apparatus of claim 9 wherein each carrier means is suspended from a pairs of pulleys, one pulley being attached to each guideline comprising the guideline means, which pulleys are independently attached to said carrier means.

12. The apparatus of claim 11 wherein each of said pulleys is connected to the carrier means by a pully-to-carrier means connector having a set length which thereby defines a maximum interpulley separation distance between the pair of pulleys for each carrier means.

13. The apparatus of claim 12 wherein the distal ends of each guideline means are secured to the lower elevation at a distance from each other which is greater than the maximum interpulley separation distance between any pair of pulleys.

14. The apparatus of claim 13 wherein a pair of guidelines making up a guideline means is maintained in a parallel configuration by a releasable constraining means encircling said pair of guidelines, which upon release increases the distal interguideline distance beyond the length of the maximum interpulley separation distance between any pair of pulleys, which effectively brakes a descending carrier means.

15. The apparatus of claim 9 wherein each guideline means spool is divided by a center flange which provides a double spool capable of accomodating a pair of guidelines.

16. The apparatus of claim 1, 2, 3, 4 or 6 wherein each carrier means comprises two or more interconnected chairs.

17. The apparatus of claim 1 or 6 wherein said support frame may be mounted on wheels.

18. The apparatus of claim 17 wherein said support frame is engageable with an anchoring means which is permanently mounted at the upper elevation.

* * * * *